United States Patent [19]

Purcell et al.

[11] Patent Number: 4,650,356

[45] Date of Patent: Mar. 17, 1987

[54] RIBBON CARTRIDGE MOTION CONTROL WITH A NON-CONCENTRIC DRIVE

[75] Inventors: Billy D. Purcell; Edward E. Toutant, both of Austin, Tex.

[73] Assignee: International Business Machines Corporation, Armonk, N.Y.

[21] Appl. No.: 617,423

[22] Filed: Jun. 5, 1984

[51] Int. Cl.[4] ..... B41J 32/00

[52] U.S. Cl. ..... 400/208; 400/212; 400/223; 400/235.1; 400/242

[58] Field of Search ..... 400/185, 194, 195, 196, 400/196.1, 207, 208, 208.1, 212, 213, 216.1, 223, 225, 228, 229, 235.1, 234, 236.1, 242

[56] References Cited

U.S. PATENT DOCUMENTS

| | | | |
|---|---|---|---|
| 3,976,183 | 8/1976 | Fleischmann et al. | 400/228 X |
| 4,091,913 | 5/1978 | Ku et al. | 400/124 |
| 4,231,667 | 11/1980 | Behrendt et al. | 400/208 |
| 4,247,210 | 1/1981 | Kacmarcik et al. | 400/236.1 |
| 4,307,969 | 12/1981 | Daughters | 400/208 |
| 4,317,636 | 3/1982 | Hume | 400/196 X |
| 4,329,072 | 5/1982 | Kacmarcik | 400/225 |
| 4,423,974 | 1/1984 | Muller et al. | 400/242 |
| 4,472,073 | 9/1984 | Valle et al. | 400/216.1 X |

FOREIGN PATENT DOCUMENTS

| | | | |
|---|---|---|---|
| 2505739 | 11/1981 | France . | |
| 0110285 | 6/1983 | Japan | 400/196.1 |

OTHER PUBLICATIONS

*IBM Technical Disclosure Bulletin,* "Supply Spool Tensioning," Cahill, vol. 25, No. 8, Jan. 1983, pp. 4058–4059.

*IBM Technical Disclosure Bulletin,* "Proportional Ribbon and Correction Feed Mechanism that does both Lift and Feed with a Single Motor," Mink et al., vol. 26, No. 1, Jun. 1983, pp. 292–293.

*IBM Technical Disclosure Bulletin,* "Variable Lift and Feed Increment Ribbon Correction Mechanism", Greenlief et al., vol. 26, No. 3B, Aug. 1983, pp. 1580–1582.

*IBM Technical Disclosure Bulletin,* vol. 26, No. 3A, Aug. 1983, "Self-Aligning Ribbon and Tape Drive", C. H. Lingle, pp. 1157–1158.

*IBM Technical Disclosure Bulletin,* vol. 26, No. 1, Jun. 1983, pp. 67–68, "Unique Cam Arrangement for Printer Ribbon Feed Mechanism", to B. D. Purcell et al.

*Primary Examiner*—Ernest T. Wright, Jr.

*Attorney, Agent, or Firm*—Marilyn D. Smith; J. F. Villella, Jr.

[57] ABSTRACT

A cartridge (1) is attached to a carrier and tiltable around a tilting axis (2). The carrier is movable along platen (3) and parallel to the print line and tilting axis (2). On the rear and on the bottom of the cartridge a drive knob (4) is provided as part of the internal cartridge ribbon drive. On the carrier a ribbon feed device with wheel (6) and upright standing blades (7) is provided. Those blades (7) cooperate with walls (9) inside the knob surface and form a kind of screw driver interconnection. Both engaging parts (7) and walls (9) allow a movement perpendicular to their rotational axis and to each other. Wheel (6) with blades (7) rotates around an axis (11) and knob (4) rotates around axis (12). Intentionally the two rotational axes (11, 12) are offset to each other relative to tilting axis (2). Thus, always a moment around this tilting axis (2) is created. To force cartridge (1) with knob (4) down onto ribbon feed wheel (6) the rotational axis (11) of wheel (6) is closer to tilting axis (2) than rotational axis (12) of the cartridge ribbon drive.

6 Claims, 13 Drawing Figures

RIBBON CARTRIDGE MOTION CONTROL WITH A NON-CONCENTRIC DRIVE

CROSS REFERENCE

Reference is made to copending application of Halter et al entitled "Ribbon Drive Coupling and Cartridge Tilt Arrangement for Print Line Visibility", Ser. No. 617,422, filed June 5, 1984.

TECHNICAL FIELD

The present invention relates to a ribbon cartridge arrangement for use in a printer, typewriter and the like comprising a cartridge attachable to a carrier that is movable along the print line. The cartridge is attached such that it is tiltable to a certain extent around an axis parallel to said print line. On the carrier a ribbon feed device for advancing the ribbon during use is provided and is engagable with drive means that form part of the cartridge to pull ribbon from the supply end to the take-up end of the cartridge. More specifically the present invention is related to the stabilization of the vertical movement of the ribbon in front of the print line.

BACKGROUND ART

In *IBM Technical Disclosure Bulletin,* Vol. 26 No. 1, June 1983, page 67–68, a cartridge is described that is attached to a carrier and that is tiltable around an axis parallel to the print line. A reversible drive is shown which in one direction is coupled with the ribbon take-up spool to feed ribbon from the supply spool to the take-up spool, and which if driven in the other direction is used to lift the cartridge to achieve print line visibility by tilting the cartridge about its pivot axis for an appropriate angle. In this known arrangement the cartridge is not coupled directly to the drive means but is installed on top of a plate that is tiltable around an axis and that connects to the drive for ribbon drive, ribbon lift oscillation and print line visibility. The specific interconnection coupling between the ribbon drive incorporated into the cartridge and the reversible ribbon feed device ending on said cartridge plate is not shown.

There are different shapes and forms of couplings, male and female parts, that cooperate with each other yet are still easily detachable.

One form is, for example, shown in U.S. Pat. Nos. 4,091,913 and 4,307,969, both depicting a ribbon cartridge with a crosshole opening on the driven ribbon spool side and a mating blade-like part as extension of the driving axle, sometimes called drive key, on the side of the ribbon feed device. Another form is shown in U.S. Pat. No. 4,231,667 depicting a ribbon cartridge drive with a tooth wheel or gear on the driving side and an adapted mating opening on the hub of the driven ribbon spool. Those known coupling designs normally provide no simple and immediate fitting and no automatic self-centering or self-coupling interconnection. In most cases in a separate action the operator has rotationally to adjust the parts such that driving and driven parts slide into each other for forming the completed coupling.

The normal attempt is to have the engaging parts of the driving ribbon feed device and the driven drive means of the cartridge arranged such that they corotate around the very same axis.

The cross-referenced copending application of Halter et al entitled "Ribbon Drive Coupling and Cartridge Tilt Arrangement for Print Line Visibility" describes a ribbon cartridge which is installed along an axis, about which it is free to pivot within certain limits. This allows the cartridge to drop when print line or writing line visibility is required. This tilting axis is slightly forward of the center of mass of the cartridge, thus, the position of the cartridge is established by the two mounting points arranged on the tilting axis and by a downstop which supports the rear of the cartridge. The downstop is provided by the driving rotating ribbon drive blades on the carrier which engage the ribbon advance knob of the cartridge at the rear of it.

As the drive blades turn, the cartridge knob is forced to turn, which feeds ribbon from the supply to the take-up end. If the blades and the cartridge knob are turning on precisely the same axis, the cartridge will remain stable. However, as intensive experiences have shown, if the two axes of rotation are not coincident, only one of the two drive blades will be engaged at any given time, thus leaving a gap between the other drive blade and its corresponding drive knob surface. This means that only one blade is driving the knob, and this produces an unbalanced force, resulting in a moment about the cartridge tilting axis. As the blades and the knob turn for a complete circle through 360°, the magnitude and direction of the force vary, which causes an undesired wobble of the ribbon cartridge and results in a vertical up and down movement of the ribbon in front of the print line. This wobble is not only disconcerting but can result in clipped characters due to unstable ribbon position. Because of tolerances in the parts, there will almost always be some misalignment between the knob and blades and hence a dissatisfying possibility of cartridge wobbling.

DISCLOSURE OF THE INVENTION

The main object of the present invention is to overcome the described drawback and to provide a simple means to assure stability of the cartridge and to avoid ribbon wobbling up and down in front of the print line.

These and other objects are accomplished in accordance with the present invention advantageously basically in that on the bottom of the cartridge and resting on the carrier the drive means are engagable and form together with the engaging part of the ribbon feed device provided on the carrier a kind of screw driver interconnection that comprises blade-like or bar-like means on one side and a slot-forming means on the other side. This so formed interconnection allows a slight relative movement of the comprised means to each other upon rotation. Furthermore, the rotational axis of the engaging part of the ribbon feed device and the rotational axis of the drive means of the cartridge are slightly offset to each other in relation to the distance from the tilting axis, so that they do not coaxially coincide and thus assure a moment about the tilting axis which is always directed in the same direction.

In accordance with the preferred embodiment of the present invention the offset is chosen such that the rotational axis of the drive means of the cartridge is further distanced relative to the tilting axis than the rotational axis of the ribbon feed device, thus assuring a moment about the tilting axis that always forces the rear of the cartridge with its drive means down onto the engaging part of the ribbon feed means provided on the carrier. By those means an always stable condition is assured regardless of the different tolerances of the involved parts.

BRIEF DESCRIPTION OF THE DRAWING

In the following, the invention will be described in detail in connection with the accompanying drawing showing an embodiment of the invention, in which.

BEST MODE FOR CARRYING OUT THE INVENTION

Figure 1:
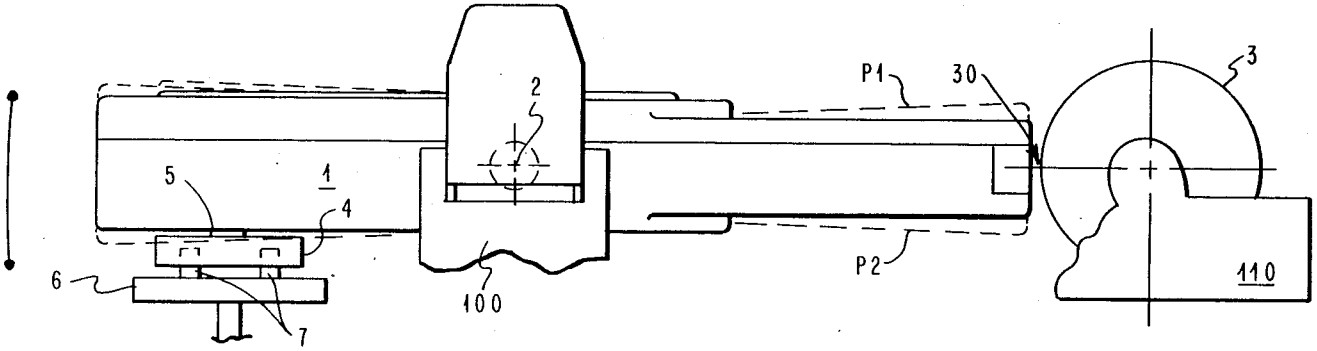
FIG. 1 is a schematic side view of the cartridge and platen.
Figure 12:
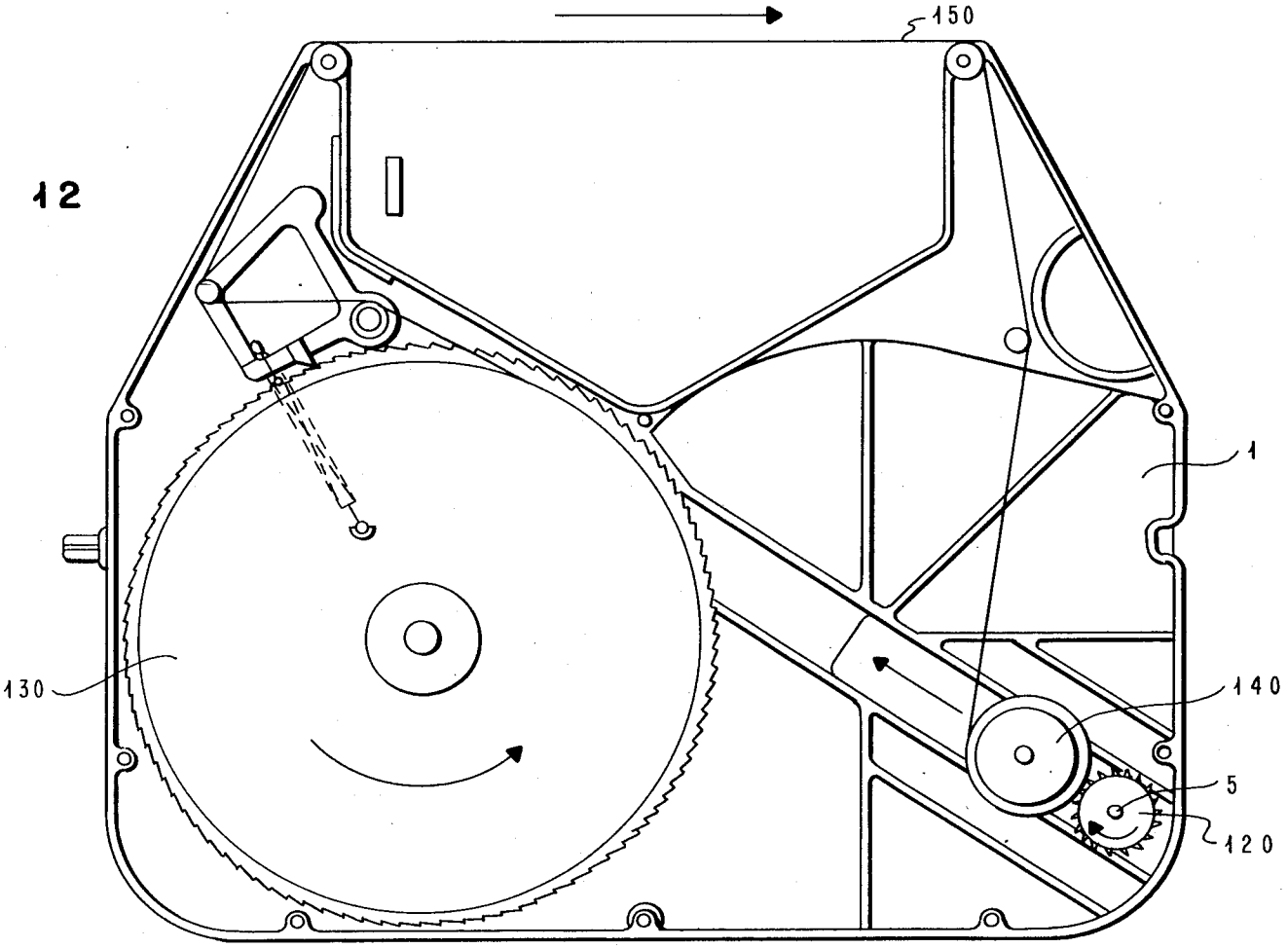
FIG. 12 is a top view of the cartridge.

FIG. 1 shows in a side view schematically a cartridge 1 tiltably supported on an axis 2 in front of a platen 3. This platen 3 belongs to a print device 110 and cartridge 1 is supported on a carrier 100 that is movable parallel to print line 30 on platen 3. At the bottom of cartridge 1 and at its rear end a ribbon advance knob 4 is provided. Knob 4 is connected through axle 5 with the ribbon drive 120 (FIG. 12) on the take-up end 140 (FIG. 12) inside cartridge 1. The lower surface of knob 4 is provided with engaging walls 9A, 9B which mate with driving surfaces 8A, 8B of driving wheel 6. On wheel 6 two driving blade 7, have roughly the shape of noses, are provided.

Figure 2:
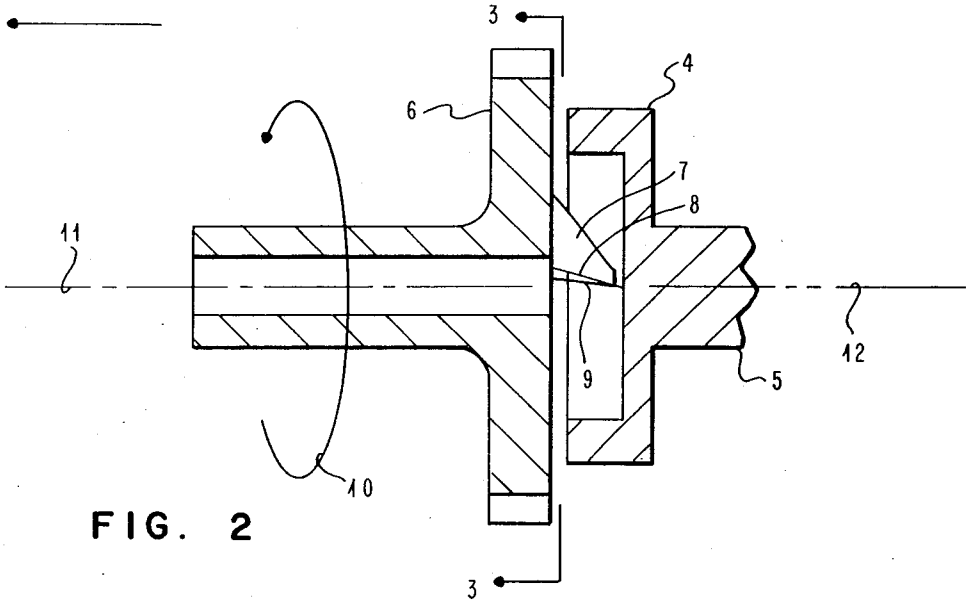
FIG. 2 is a schematic cross sectional view of the driving wheel gear with two blades and the ribbon advance knob of the cartridge.
Figure 3:
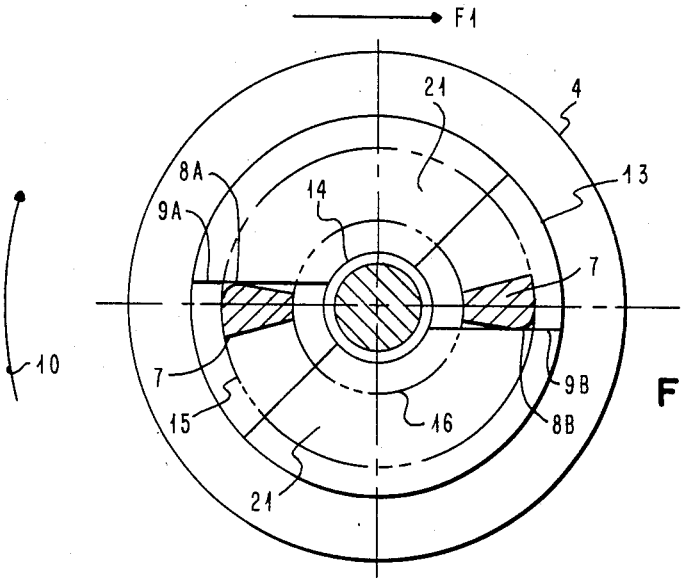
FIG. 3 is view in direction 3—3 along line 3—3 of FIG. 2 whereby the rotational axis of the different parts are aligned with each other.

Each blade 7 has a driving surface 8, best seen in profile in FIG. 2. Each blade surface 8 abuts against a mating wall 9 provided on knob 4. As can be seen in FIGS. 2 and 3, when ribbon feed wheel 6, which is shown as a gear in FIG. 2, is driven in direction of arrow 10 with blade surface 8 leading, knob 4 is then taken with it in the very same direction. Thus, ribbon 150 (FIG. 12) is fed to the take-up side 140 (FIG. 12) from supply side 130.

FIG. 3 is a view along line 3—3 of FIG. 2 showing the cooperation of blades 7 with its surfaces 8 with the walls 9 of knob 4. Walls 9 are arranged radially symmetrically on knob 4 and allow an axial misalignment with the driving surfaces 8 of blades 7. Thus, a slight relative movement of the engaging parts to each other upon rotation is allowed in any direction perpendicular to the rotational axis. For further details of the design of the interconnection coupling reference is made to the copending application of Halter et al entitled "Ribbon Drive Coupling and Cartridge Tilt Arrangement for Print Line Visibility", Ser. No. 617,422, filed June 5, 1984, which is herewith incorporated by reference.

Figure 13:
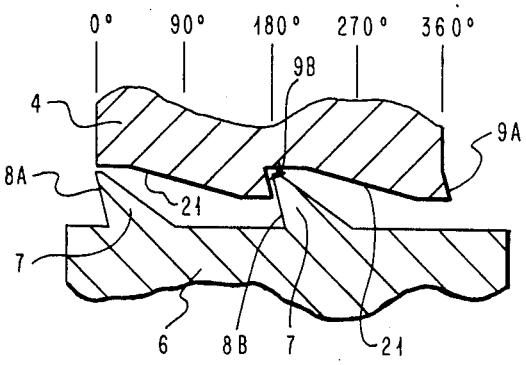
FIG. 13 is a schematic diagram of the circular cross section structure of the driving wheel gear with two blades and the ribbon advance knob shown in a 360 degree unwound, straightened representation.

As described in the above stated incorporated application Ser. No. 617,422, the interconnection coupling is described as slot forming means which are made up of two walls 9A, 9B that stand essentially upright from the surface of a turnable wheel forming the ribbon advance knob 4. These walls 9A, 9B are arranged radially symmetrically to each other and are provided with a ramp 21 formed on their back. These ramps 21 extend inwardly toward the cartridge 1 so that upon turning of the ribbon feed device in ribbon feed direction the cartridge 1 drops automatically down into feeding engagement to operatively provide a screw driver interconnection. Walls 9A, 9B and ramps 21 are shown in the unwound straightened representation in FIG. 13.

As seen from FIG. 2 blades 7 rotate with wheel 6 around axis 11. Knob 4 rotates around axis 12. In the representation of FIG. 3 both axes 11 and 12 fall together. Therefore, the circles 13 and 14 of the outer edge and the inner edge of walls 9 are concentric to the circles 15 and 16 of blades 7 with their driving surfaces 8. If blades 7 and knob 4 corotate concentrically, then both blade surfaces 8A and 8B contact at all times their associated walls 9A and 9B of knob 4. This means a steady wobble-free rotational drive.

Figure 4:
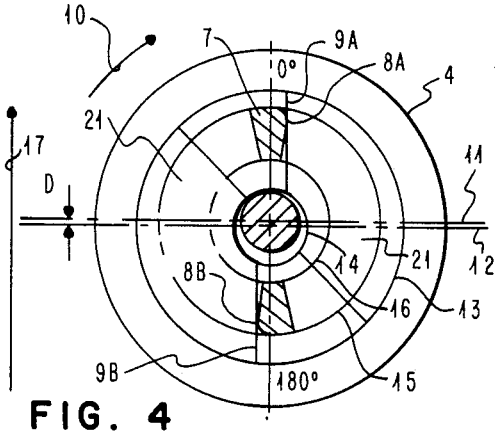
FIGS. 4–11 show the relationship and driving engagement between the two blades and the driven knob walls in different positions, staggered for 45° each, starting with the 0° and ending in the very same 360° position of FIG. 4.

FIG. 4 shows an intentional offset of rotational axis 11 of blades 7 with driving surfaces 8A, 8B relative to the rotational axis 12 of knob 4 with its driven knob walls 9A and 9B. This intentional offset D is provided in accordance with the present invention. Arrow 17 points toward tilting axis 2 and platen 3. Rotational axis 11 of blades 7 is shown to be closer to the tilting axis 2 than rotational axis 12 of knob 4. The difference D in distance from tilting axis 2 is the sum of the worst case tolerances. By this measure there is assured that there will always be a moment about tilting axis 2 tending to tilt cartridge 1 down onto blades 7. There is no shift of the rotational axis 11 and 12 in the direction of tilting axis 2.

The series of FIGS. 4–11 show the relationship between blades 7 with their driving surfaces 8A and 8B and knob walls 9A and 9B in different angular positions. FIG. 4 shows blade surfaces 8A, 8B and knob walls 9A and 9B in vertical position, which is also considered to the be 0° or 360° position. Driving rotation procedes in clockwise direction 10. Both blade surfaces 8A and 8B abut against walls 9A and 9B. Circles 13 and 14 of walls 9A and 9B are not concentric to circles 15 and 16 of blades 7 or blade surfaces 8A and 8B, respectively.

Figure 5:
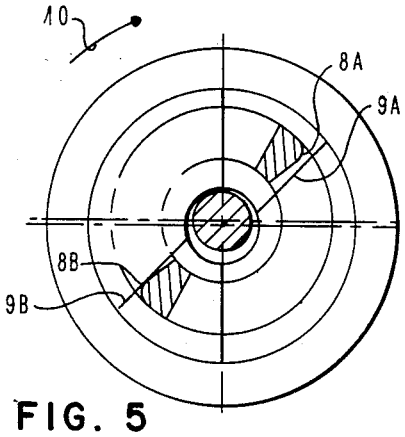
Figure 6:
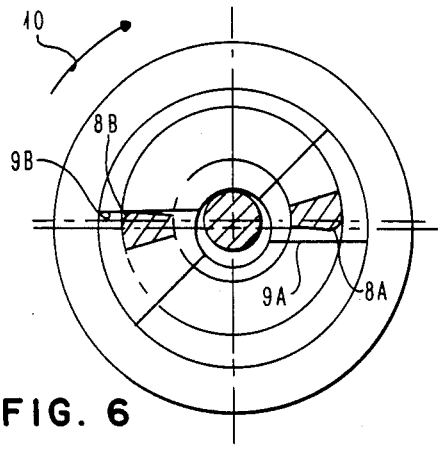
Figure 7:
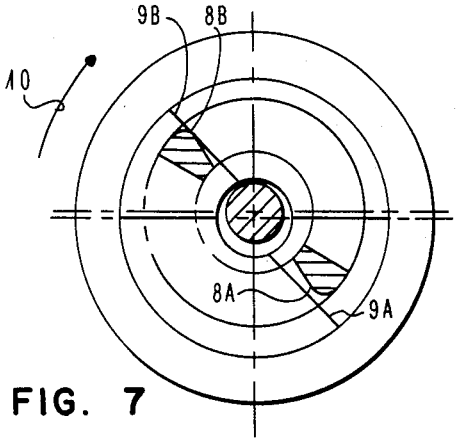
Figure 8:
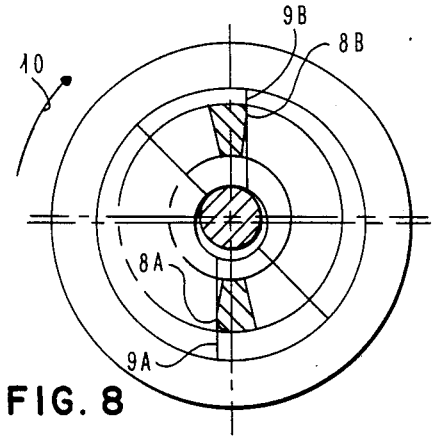

FIG. 5 shows the 45° position in which only blade surface 8B abuts in driving connection at knob wall 9B. Between blade surface 8A and knob wall 9A there is a gap. FIG. 6 shows the 90° position in which the gap has even increased between blade surface 8A and knob wall 9A. FIG. 7 shows the 135° position. Blade surface 8B still abuts singly against knob wall 9B. The gap between blade surface 8A and knob wall 9A has diminished. FIG. 8 shows the 180° position, that is similar to the 0° or 360°, respectively, position, only that the blade surfaces 8A and 8B and also the knob walls 9A and 9B have exchanged locations.

Figure 9:
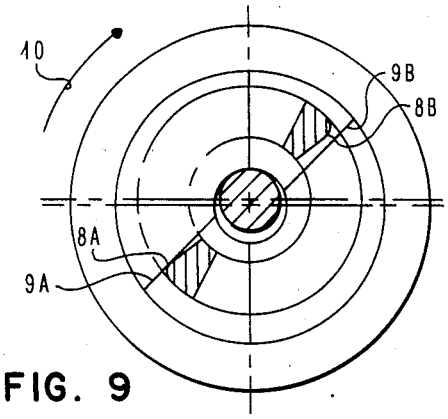
Figure 10:
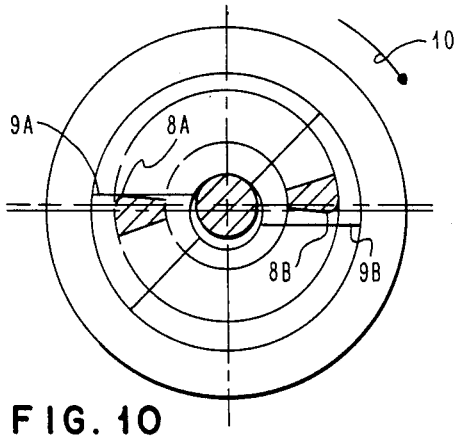
Figure 11:
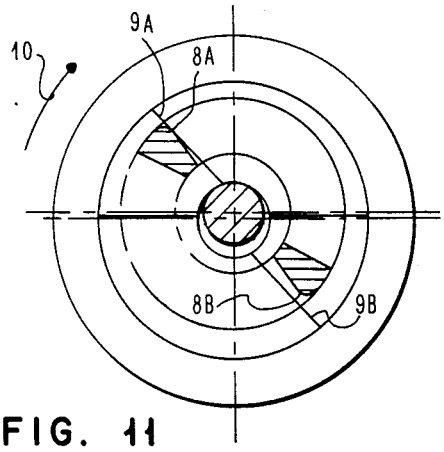

FIG. 9 shows the 225° position. Blade surface 8A now drives knob wall 9A and the gap is between blade surface 8B and knob wall 9B. The position is similar to the 45° position of FIG. 5. FIG. 10 shows the 270° position in which blade surface 8A abuts against knob wall 9A. This position is similar to the one of FIG. 6. Finally, FIG. 11 shows the 315° position in which blade surface 8A drives on knob wall 9A and the gap between blade surface 8B and knob wall 9B is diminishing.

As can be seen from FIGS. 4–11, driving contact exists only in the left half of knob 4 between 180° and 360° or 6 and 12 o'clock, respectively. This means a force F1 exists in direction toward tilting axis 2 as indicated in FIG. 1. This force F1 in this direction at knob 4 causes a moment about tilting axis 2 that tends to urge cartridge 1 into position P1, indicated by broken lines in FIG. 1. This is a desired force as it urges cartridge 1 onto blade wheel 6 thus assuring a stable position relative to platen 3.

A force F2 in opposite direction tends to urge cartridge 1 into position P2. This would be the case if knob axis 12 would be closer to tilting axis 2 than blade axis 11.

While this invention has been particularly shown and described with reference to a preferred embodiment thereof, it will be understood by those skilled in the art that the foregoing and other changes in form and details may be made therein without departing from the spirit and scope of the invention.

We claim:

1. A ribbon cartridge arrangement for use in a printer, typewriter and the like comprising a cartridge attachable to a carrier that is movable along a print line, and attached such that the cartridge is tiltable to a certain extent around an axis parallel to said print line, further comprising on said carrier a ribbon feed device for advancing a ribbon during use, said ribbon feed device being engagable with drive means that form part of said cartridge to pull said ribbon from a supply end to a take-up end of said cartridge, characterized in that, (a) on a bottom of said cartridge (1), resting on the carrier, said drive means (4, 5) are engagable and together with an engaging part (7, 8) of said ribbon feed device (6) form a kind of screw driver interconnection that comprises blade-like means (7, 8) on one side and slot forming means (9) on the other side, said interconnection allowing a slight relative movement of the drive means and the ribbon feed device to each other upon rotation, (b) a rotational axis (11) of said engaging part of said ribbon feed device and a rotational axis (12) of said drive means of said cartridge being slightly offset to each other in relation to the distance from said tilting axis (2) so that they do not coaxially coincide, thus assuring a moment about said tilting axis that is always in the same direction (P1 or P2).

2. The ribbon cartridge arrangement of claim 1, wherein said offset (D) is chosen such that said rotational axis (12) of said drive means of said cartridge is further distanced relative to said cartridge tilting axis (2) than said rotational axis (11) of said ribbon feed device (6, 7), thus assuring a moment about said tilting axis that always forces the rear of said cartridge with its drive means down (P1) onto said engaging part of said ribbon feed device.

3. The ribbon cartridge arrangement of claim 1, wherein said engaging part of said ribbon feed device includes a blade-like bar that extends diametrically to both sides of said rotational axis of said ribbon feed device and is arranged along a diameter of a rotational circle of a feed wheel forming part of said ribbon feed device.

4. The ribbon cartridge arrangement of claim 1, wherein said blade-like means is formed by two noses (7) that are arranged radially symmetrical to each other on a feed wheel (6) forming part of said ribbon feed device.

5. The ribbon cartridge arrangement of claim 1, wherein said drive means (4, 5) of said cartridge includes said slot forming means (9).

6. The ribbon cartridge arrangement of claim 1, wherein said slot forming means is made up of two walls (9) that stand essentially upright from the surface of a turnable wheel (4) that is provided on the bottom of said cartridge, said two walls are arranged radially symmetrical to each other and have a ramp formed on their back, said ramp extending inwardly toward said cartridge so that upon turning of said ribbon feed device said cartridge drops down and said screw driver interconnection is actively formed.

* * * * *